United States Patent [19]

Holtz

[11] Patent Number: 5,033,640

[45] Date of Patent: Jul. 23, 1991

[54] WALL FOR A FLUID CONTAINER

[75] Inventor: Maurice Holtz, Huntingdon Valley, Pa.

[73] Assignee: Joseph Oat Corporation, Camden, N.J.

[21] Appl. No.: 535,929

[22] Filed: Jun. 8, 1990

[51] Int. Cl.[5] ..... B65D 88/26

[52] U.S. Cl. ..... 220/646; 220/669; 220/565

[58] Field of Search ..... 220/565, 5 A, 669, 646, 220/651

[56] References Cited

U.S. PATENT DOCUMENTS

| | | | |
|---|---|---|---|
| 2,870,981 | 1/1959 | Dellinger et al. | 220/669 |
| 3,469,731 | 9/1969 | Brucker | 220/669 |
| 3,528,582 | 9/1970 | Rigollot | 220/669 |
| 4,860,915 | 8/1989 | Clements | 220/669 |

*Primary Examiner*—Joseph Man-Fu Moy

*Attorney, Agent, or Firm*—Panitch Schwarze Jacobs & Nadel

[57] ABSTRACT

A wall for a fluid container which includes a pair of vertically extending side beams between a pair of horizontally extending upper and lower beams. An arcuate panel is secured in the area defined by the vertically and horizontally extending beams. When the fluid container is filled iwth a fluidic material, fluid pressure applied to the arcuate inner surface deflects the panel downwardly in tension to force the upper beam downwardly to thereby compress the side beams between the upper and lower beams and thereby add significant static structural integrity to the wall.

8 Claims, 2 Drawing Sheets

WALL FOR A FLUID CONTAINER

FIELD OF THE INVENTION

The present invention relates to a wall for a fluid container and, more particularly, to the interrelated structure of a wall for a large fluid container.

BACKGROUND OF THE INVENTION

Large fluid containers are typically comprised of rectangular or cylindrical steel tanks which are filled with a fluid material, such as water. Conventional steel tanks or fluid containers include vertical side walls which consist of flat or planar panels which are strengthened by bars or beams that are located at intervals along the panels to reduce the free span area of the panels to thereby reduce the flexural stresses in the panels or side walls. Other conventional fluid containers include side walls wherein the panels are deformed or corrugated to create beams within the panels.

Thus, conventional side walls for large fluid containers are constructed so that the panels and beams are stressed in flexure and are designed by traditional flexure formulas to achieve optimum economy with respect to the total weight of the panels and beams.

The total weight of the fluid container is directly related to the cost of the fluid container. Thus, there is a need in the fluid container field for reducing the overall weight of such large fluid containers to thereby reduce the overall cost thereof.

The present invention overcomes many of the disadvantages inherent in the above-described side walls of large fluid containers by utilizing the weight of the fluid material within the fluid container to compress the vertically extending beams of the fluid container. By compressing the vertically extending beams of the fluid container the strength of the container is significantly increased and the free span area of the panels between the beams can be increased. Thus, the number of vertically extending beams per foot of wall and the thickness of the panels is decreased to thereby reduce the overall weight of the fluid container. In the present invention, the panels are generally arcuate so that when the fluid container is filled with fluid they are stressed in tension as well as flexure to thereby compress the vertically extending beams to increase the strength thereof and reduce the amount of material needed to adequately construct the fluid container. Therefore, use of the present invention results in considerable savings in the cost of fabricating large fluid containers.

SUMMARY OF THE INVENTION

Briefly stated, the present invention comprises a wall for a fluid container. The wall comprises an upper beam and a first side beam having an upper end, a lower end, a first side and a second side. The upper end of the first side beam is secured to the upper beam. The wall further comprises a second side beam having an upper end, a lower end, a first side and a second side The upper end of the second side beam is secured to the upper beam at a distance from the first side beam. The lower end of the first side beam is secured to a lower beam. The lower end of the second side beam is also secured to the lower beam at a distance from the first side beam. Thus, an area is defined between the second side of the first side beam and the first side of the second side beam and the upper and lower beams. A panel is complementarily sized and securably positioned within the area in a fluid tight manner. The panel includes an upper end, a lower end, an inner surface, a first side end and a second side end. The upper end of the panel is secured to the upper beam between the first and second side beams. The lower end of the panel is secured to the lower beam between the first and second side beams. The first side end of the panel is secured to the second side of the first side beam between the upper and lower beams. The second side end of the panel is secured to the first side of the second side beam between the upper and lower beams. The inner surface of the panel is generally arcuate between the upper and lower beams such that the inner surface of the panel faces radially inwardly. Upon application of fluid pressure to the inner surface, the panel deflects downwardly in tension to force the upper beam downwardly to thereby compress the first and second side beams between the upper and lower beams such that the first and second side beams act as columns.

BRIEF DESCRIPTION OF THE DRAWINGS

The foregoing summary, as well as the following detailed description of the preferred embodiment, is better understood when read in conjunction with the appended drawings. For the purpose of illustrating the invention, there is shown in the drawings an embodiment which is presently preferred, it is understood, however, that the invention is not limited to the specific methods and instrumentalities disclosed. In the drawings.

DESCRIPTION OF PREFERRED EMBODIMENT

Figure 1:
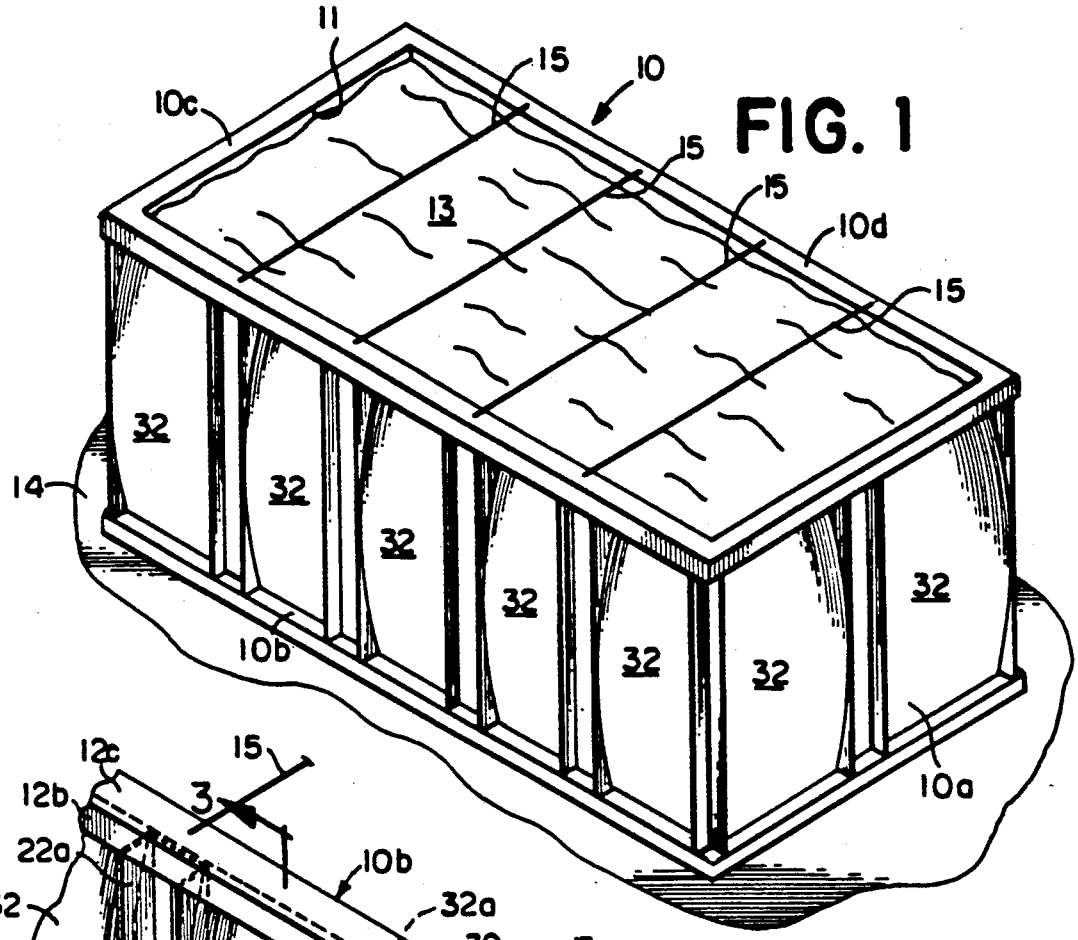
FIG. 1 is a perspective view of a large fluid container having side walls in accordance with the present invention.

Certain terminology is used in the following description for convenience only and should not be considered limiting. For example, the words "right," "left," "lower" and "upper" designate directions in the drawings to which reference is made. The words "inwardly" and "outwardly" refer to directions toward and away from, respectively, the geometric center of the wall for the fluid container and designated parts thereof. The terminology includes the words above specifically mentioned, derivatives thereof and words of similar import.

Referring to the drawings in detial, wherein like numerals indicate like elements throughout, there is shown in FIGS. 1 through 5 a preferred embodiment of a wall for a fluid container in accordance with the present invention. FIG. 1 perspectively illustrates a fluid container, generally designated 10, having four vertical side walls 10*a*, 10*b*, 10*c* and 10*d* in accordance with the present invention. The fluid container 10 preferably includes a bottom wall (not shown) interconnected with the side walls 10*a*, 10*b*, 10*c* and 10*d* of the fluid container 10 to thereby define a storage area 11 for a fluidic material 13, such as water. In the present embodiment, it is preferred that the side walls 10*a*, 10*b*, 10*c* and 10*d* and the bottom wall be sealingly interconnected such that fluidic material 13 cannot pass therebetween, as described in more detail below.

It is understood by those skilled in the art, that the present invention is not limited to any particular type of fluidic material to be stored within the storage area 11 of the fluid container 10. That is, the fluid container 10 can store or house a variety of fluidic material 13 in either the liquid of solid state, such as water, sand or oil without departing from the spirit and scope of the invention.

The fluid container 10 and the various components thereof, described hereinafter, are preferably constructed of a lightweight high strength metallic material such as steel, unless otherwise indicated. However, it is understood by those skilled in the art, that the fluid container 10 and the various components thereof can be constructed of other lightweight high strength materials, such as composite fibrous materials.

For purposes of convenience only, the various components of the fluid container 10 described hereinafter are preferably secured together by welding to thereby create fluid tight connections. However, it is understood by those skilled in the art, that other fastening methods can be utilized to interconnect the various components of the fluid container 10, such as standard hardware fasteners with a resilient seal or selaing compound (e.g., caulk) disposed between the connected components.

Figure 2:
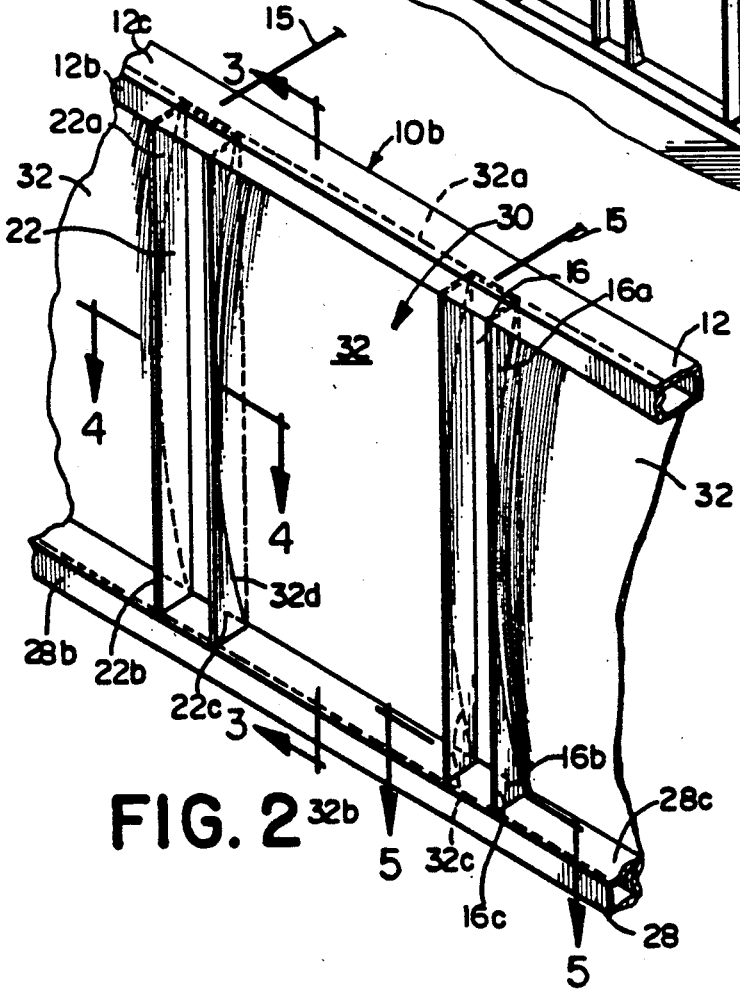
FIG. 2 is a fragmentary view of a portion of a wall of the fluid container of FIG. 1 in accordance with the present invention.

Referring now to FIG. 2, there is shown a representative portion of the wall **10*b* of the fluid container 10 in accordance with the present invention. For purposes of convenience only, the following description of the reprsentative portion of the wall 10*b* is equally applicable to the remaining identical portions of the wall 10*b* as well as the other walls 10*a*, 10*c* and 10*d* of which the fluid container 10 is constructed. It is understood by those skilled in the art, that the fluid container 10** could be constructed of any number of walls of differing or identical lengths without departing from the spirit and scope of the invention.

Figure 3:
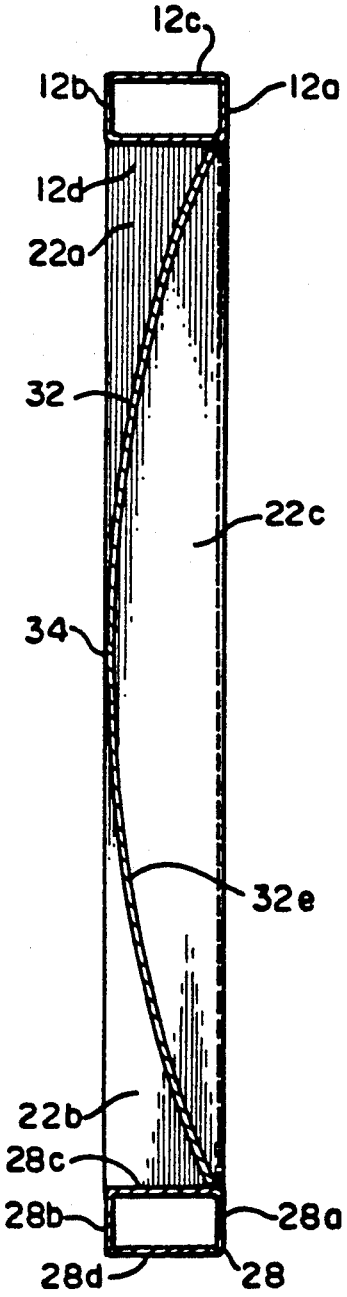
FIG. 3 is an enlarged cross-sectional view of the wall of FIG. 2 taken along line 3—3 of FIG. 2.

Referring now to FIGS. 2 and 3, the wall **10*b* includes an upper beam 12 extending generalloy linearly and horizontally with respect to the ground 14. The upper beam 12 is preferably generally rectangular in cross section and is preferably generally hollow to thereby reduce the overall weight thereof. As shown in FIG. 3, the upper beam includes an inner surface 12*a*, outer surface 12*b*, upper surface 12*c* and a lower surface 12*d***.

While in the presently preferred embodiment, the upper beam 12 is generally rectangular in cross-section, it is understood by those skilled in the art, that the upper beam 12 can be of other geometric configurations in cross section. For instance, the upper beam 12 coul dhave a generally I- and U-shaped cross section without departing from the spirit and scope of the invention. It is further understood by those skilled in the art, that the upper beam 12 can be non-linear or positioned at an angle with respect to the ground 14.

Figure 5:
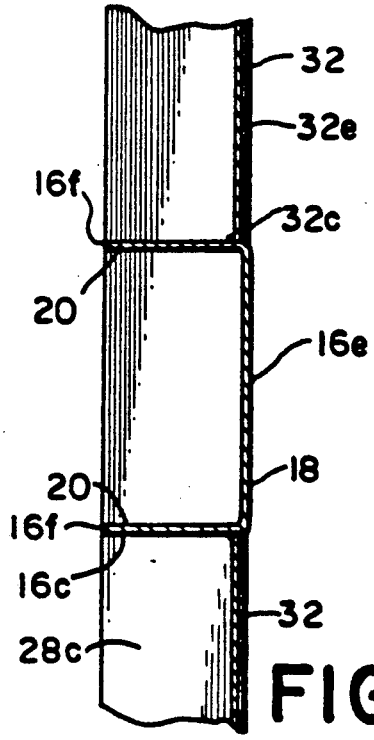
FIG. 5 is a greatly enlarged cross-sectional view of the wall of FIG. 2 taken along line 4—4 of FIG. 2.

Referring now to FIGS. 2 and 5, there is shown a first side beam 16 having an upper end **16*a*, lower end 16*b*, a first side 16*c* and a second side 16*d*. The upper end 16*a* of the first side beam 16 is secured to the of the upper beam 12, preferably at the lower surface 12*d*. The first side beam 16 further includes an inner surface 16*e* and an oppositely facing outer surface 16*f***.

In the present embodiment, it is preferred that the first side beam 16 be generally U-shaped in cross-section having a web portion 18 and a pair of legs 20 depending generally perpendicularly therefrom. However, it is understood by those skilled in the art, that the first side beam 16 can be of other geometrical configurations such as generally T-shaped or a solid rectangle in cross section.

Figure 4:
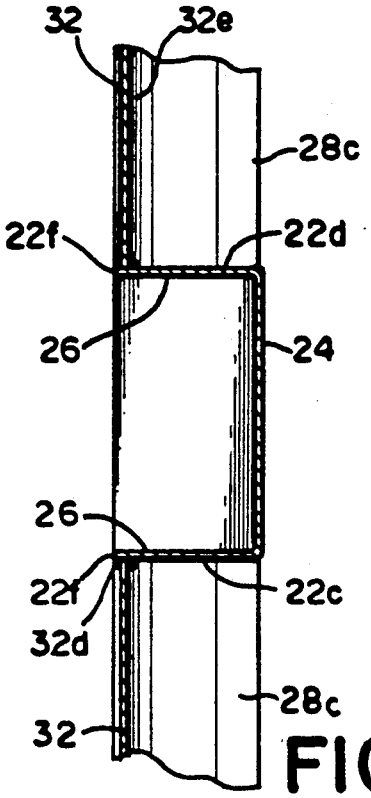
FIG. 4 is a greatly enlarged cross-sectional view of the wall of FIG. 2 taken along line 4—4 of FIG. 2.

Referring now to FIGS. 2, 3, and 4, the wall **10*b* includes a second side beam 22 having an upper end 22*a*, a lower end 22*b*, a first side 22*c*, a second side 22*d*, an inner surface 22*e* and an outer surface 22*f* facing oppositely from said inner surface 22*e*. The upper end 22*a* of the second side beam 22 is secured to the upper beam 12 preferably at the lower surface 12*d* and at a distance from the first side beam 16**.

In the present embodiment, it is preferred that the second side beam 22 be generally U-shaped in cross-section. That is, the second side beam includes a web portion 24 and a pair of legs 26 depending generally perpendicularly therefrom. However, it is understood by those skilled in the art, that the second side beam 22 can be constructed of other geometrical configurations in cross-section, as discussed above in connection with the first side beam 16.

The wall **10*b* further includes a lower beam 28 which is generally identical to the upper beam 12. Thus, for convenience only, further description of the configuration of the lower beam 28 is omitted and is neither necessary nor limiting. However, for purposes of clarity, the reference numerals for the lower beam 28 corresponds to like elements of the upper beam 12**.

As shown in FIG. 2, the lower end **16*b* of the first side beam 16 is secured to the upper surface 28*c* of the lower beam 28. Similarly, the lower end 22*b* of the second side beam 22 is secured to the upper surface 28*c* of the lower beam 28 at a distance from the first side beam 16. In the present embodiment, it is preferred that the first and second side beams 16, 22 be secured to the upper and lower beams 12, 22 such that the first and second side beams 16, 22 extend vertically and perpendicularly therefrom, such that said first and second side beams 16 and 22 and the upper and lower beams 12, 28 are generally co-planar. However, it is understood by those skilled in the art, that the first and second side beams 16, 22 can be secured to the upper and lower beams 12, 28 at an acute or obtuse angle with respect thereto with said first and second side beams 16, 22 and the upper and lower beams 12, 28, so long as the first and second side beams 16, 22** act as columns as discussed below, without departing from the spirit and scope of the invention.

As best shown in FIG. 2, an area 30 is defined between the second side **16*d* of the first side beam 16 and the first side 22*c* of the second side beam 22 and the lower surface 12*d* of the upper beam 12 and upper surface 28*c* of the lower beam 28. In the present embodiment, it is preferred that the area 30 be generally rectangular in shape. However, it is understood by those skilled in the art, that the area 30** could be of other shapes, such as generally trapezoidal or square.

Referring now to FIGS. 2 and 3, a panel 32 is complementarily sized and securably positioned within the area 30 in a fluid tight manner. L The panel has an upper end **32*a*, a lower end 32*b*, an inner surface 32*e*, a first side end 32*c* and a second side end 32*d***.

More particularly, the upper end **32*a* of the panel 32 is secured to the upper beam 12 between the first and second side beams 16, 22. In the present embodiment, it is preferred that the upper end 32*a* of the panel 32 be in facing engaging relationship with the lower surface 12d of the upper beam 12**, such that fluid cannot pass therebetween.

The lower end 32b of the panel 32 is secured to the lower beam 28 between the first and second side beams 16, 22. Similarly, it is preferred that the lower end 32b of the panel 32 be in facing engaging relationship with the upper surface 28c of the lower beam 28 such that fluid is unable to pass therebetween.

The first side end 32c of the panel 32 is secured to the second side 16d of the first side beam 16 between the upper and lower beams 12, 28. In the present embodiment, it is preferred that the first side end 32c of the panel 32 be in facing engaging relationship with the second side 16d of the first side beam 16 such that fluid cannot pass therebetween.

The second side end 32d of the panel 32 is secured to the first side 22c of the second side beam 22 between the upper and lower beams 12, 28. In the present embodiment, it is preferred that the second side end 32d of the panel 32 be in facing engaging relationship with the first side 22d of the second side beam 22, such that fluid cannot pass therebetween.

As best shown in FIG. 3, the inner surface 32e of the panel 32 is preferably generally arcuate between the upper and lower beams 12, 28 such that the inner surface 32e of the panel 32 faces radially inwardly. In the present embodiment, the generally arcuate surface 32e has a generally uniform radius of curvature. However, it is understood by those skilled in the art, that the inner surface 32e can be of any radius of curvature so long as the first side end 32c and the second side end 32d are secured to the second side 16d of the first side beam 16 and the first side 22c of the second side beam 22 in a fluid tight manner.

As shown in FIG. 3, the generally arcuate inner surface 32e includes a crown 34 positioned proximate the outer surface 16f, 22f of the first and second side beams 16, 22. Further, in the present embodiment it is preferred that the upper and lower ends 32a, 32b of the panel 32 be positioned proximate the inner surface 16e, 22e of the first and second side beams 16, 22. It is further preferred that the crown 34 of the inner surface 32e be equidistantly spaced between the upper and lower beams 12, 28.

However, it is understood by those skilled in the art, that the present invention is not limited to the particular shape of the panel 32 or its specific relationship with the upper and lower beams 12, 28 and a first and second side beam 16, 18 so long as when fluid pressure is applied to the inner surface 32e thereof, the panel 32 is placed in tension.

As mentioned previously, for convenience only the above description of the wall 10b is directed to a pair of side beams 16 and 22 and a single panel 32. It is understood by those skilled in the art, that the wall 10b can include a plurality of side beams positioned between the upper and lower beams 12, 28 and a corresponding number of panels 32 depending upon the length thereof, as shown in FIG. 1.

As mentioned above, the fluid container 10 can be comprised of any number of vertical side walls. In the present embodiment, it is preferred that the side walls of the fluid container be welded together where two side beams are engaged, as shown in FIG. 1.

Depending on the characteristics and size of the fluid container 10 it may be necessary to include tie rods 15 between the upper beams of the walls 10b and 10d preferably at corresponding side beams to prevent the walls 10b and 10d from bowing outwardly, as shown in FIG. 1. However, it is understood by those skilled in the art that the rods 40 are not pertinent to the present invention and may be ommitted depending on the size of the fluid contianer 10 and the fluidic material to be stored therein.

In use, when the fluid container is filled with the fluidic material 13, fluid pressure is applied to the inner surface 32e of the panel 32. The resultant force of the fluid pressure on the panel 32 results in the panel deflecting outwardly in flexure, as well as downwardly in tension, as is understood by those skilled in the art. When the panel 32 deflects downwardly in tension, it also forces the upper beam 12 downwardly as a result of the connection between the upper end 32a of the panel 32 and the lower surface 12d of the upper beam 12. When the upper beam 12 deflects downwardly, the first and second side beams 16, 22 are compressed between the upper and lower beams 12, 28 to thereby give the first and second side beams 16, 22 significant static structural integrity.

The walls 10a, 10b, 10c and 10d of the fluid container 10 can thus be constructed of less material due to the arcuate inner surface 32e. More particularly, the panels 32 can be constructed at a relatively less thickness and the space between the side beams is greater than in conventional beam-strengthening side beams.

As is understood by those skilled in the art, the above described arrangement of the upper and lower beams 12, 28, the first and second side beams 16, 22 and the panel 32 provides significant resistance against force applied to the inner surface 32e of the panel 32. Further, the cross section shown in FIG. 4 of the pair of adjoining plates 32 and the second side beam 22 yields a composite section that is strongest where the bending moment as a result of the fluid pressure is greatest. Further, the high moment of inertia that this composite section has at approximately the midpoint of the second side beam 22 adds significant stability to the second side beam 22.

As a result of the present invention, the comparative weight of a wall fabricated in accordance with the present invention is approximately one half the weight of a conventional wall having the same dimensions. Further the cost of such fabrication as measured by the length of welding is also less to thereby achieve the present inventions goal of significantly reducing the costs of large fluid containers without sacrificing their strength characteristics.

It is understood by those skilled in the art, that a pair of panels 32 could be interposed between the upper and lower beams 12, 28 with a horizontal intermediate beam (not shown) disposed between the panels 32 and extending from the first side beam 16 to the second side beam 28. With such a structure, the intermediate beam would not be subject to significant force from the fluid within the container. Further, the fluid container 10 could have twice the capacity of a single panel container without raising the cost by having custom size panels manufactured.

From the foregoing description, it can be seen that the present invention comprises a wall for a fluid container. It is recognized by those skilled in the art, that changes may be made to the above-described embodiments of the invention without departing from the broad inventive concept thereof. It is understood, therefore, that this invention is not limited to the particular embodiments disclosed, but is intended to cover all modifications which are within the spirit and scope of the invention as defined by the appended claims.

I claim:

1. A wall for a fluid container, said wall comprising: an upper beam;

a first side beam having an upper end, a lower end, a first side and a second side, said upper end of said first side beam being secured to said upper beam;

a second side beam having an upper end, a lower end, a first side and a second side, said upper end of said second side beam being secured to said upper beam at a distance from said first side beam;

a lower beam, said lower end of said first side beam being secured to said lower beam, said lower end of said second side beam being secured to said lower beam at a distance from said side beam and an area is defined between said second side of said first side beam and said first side of said second side beam and said upper and lower beams; and a panel being complementarily sized and securably positioned within said area in a fluid tight manner, said panel having an upper end, a lower end, an inner surface, a first side end and a second side end, said upper end of said panel being secured to said upper beam between said first and second side beams, said lower end of said panel being secured to said lower beam between said first and second side beams, said first side end of said panel being secured to said second side of said first side beam between said upper and lower beams, said second side end of said panel being secured to said first side of said second side beam between said upper and lower beams, said inner surface of said panel being generally arcuate between said upper and lower beams such that said inner surface of said panel faces radially inwardly whereby upon application of fluid pressure to said inner surface, said panel deflects downwardly in tension to force said upper beam downwardly to thereby compress said first and second side beams between said upper and lower beams.

2. The wall as recited in claim 1, wherein said generally arcuate inner surface has a generally uniform radius of curvature.

3. The wall as recited in claim 1, wherein said first and second side beams have an inner surface and an oppositely facing outer surface and said generally arcuate inner surface having a crown, said crown being positioned proximate said outer surface of said first and second side beams and said upper and lower ends of said panel being positioned proximate said inner surface of said first and second side beams.

4. The wall as recited in calim 1, wherein said first side end of said panel is in facing engaging relationship with said second side of said first side beam, said second side end of said panel is in facing engaging relationshp with said first side of said second side beam, said upper end of said panel being inf acing engaging relationship with a surface of said upper beam, and said lower end of said panel being in facing engaging relationship with a surface of said lower beam whereby said wall is impervious to fluid.

5. The wall as recited in claim 4, wherein said crown of said inner surface is equidistantly spaced between said upper and lower beams.

6. The wall as recited in claim 1, wherein said first and second side beams are channels having a generally U-shaped cross section.

7. The wall as recited in claim 1, further including a plurality of said side beams positioned between said upper and lower beams and a corresponding number of said panels.

8. The wall as recited in claim 1, wherein said panel is secured to said upper beam, lower beam, first side beam and second side beam by welding.

* * * * *